United States Patent [19]

Oberrauch et al.

[11] Patent Number: 4,544,450

[45] Date of Patent: Oct. 1, 1985

[54] ELECTROCHEMICAL PROCESS FOR THE SYNTHESIS OF ORGANIC COMPOUNDS

[75] Inventors: Ermanno Oberrauch, Milan, Italy; Lennard Eberson, Lund, Sweden

[73] Assignee: Anic S.p.A., Palermo, Italy

[21] Appl. No.: 509,863

[22] Filed: Jun. 30, 1983

Related U.S. Application Data

[63] Continuation of Ser. No. 275,609, Jun. 22, 1981, abandoned.

[30] Foreign Application Priority Data

Jul. 15, 1980 [IT] Italy ..... 23441 A/80

[51] Int. Cl.[4] ..... C25B 3/00

[52] U.S. Cl. ..... 204/59 R; 204/72

[58] Field of Search ..... 204/59 R, 72

[56] References Cited

U.S. PATENT DOCUMENTS

| | | | |
|---|---|---|---|
| 4,024,032 | 5/1977 | Weinberg | 204/59 R |
| 4,101,392 | 7/1978 | Hallcher et al. | 204/59 R |
| 4,119,941 | 4/1979 | Mitzlaff et al. | 204/59 R |

*Primary Examiner*—Howard S. Williams

*Attorney, Agent, or Firm*—Morgan, Finnegan, Pine, Foley & Lee

[57] ABSTRACT

An electrochemical process is disclosed for the synthesis of organic compounds, said process having the unique characteristic that the element evolved at the anode is exploited by having it reacting with the product of electrolysis obtained at the cathode by the presence of an appropriate catalyst. The catalyst may be associated in the most convenient manner to the anode, or it can be the anode itself. The process opens the way to a number of synthesis reaction which may be carried out electrolytically instead of the conventional ways.

7 Claims; No Drawings

ELECTROCHEMICAL PROCESS FOR THE SYNTHESIS OF ORGANIC COMPOUNDS

This is a continuation of application Ser. No. 275,609 filed June 22, 1981, now abandoned.

The present invention has as its subject matter an electrochemical process for the synthesis of organic compounds, said process providing for the electrolysis of an organic substrate and the reaction of the product thereof with the product which is formed at the counter-electrode, in the presence of a catalyst, which latter can be, with advantage, the same material of the counter-electrode.

It is known that, in the majority of the organic electrochemical processes, only the products which are formed at either electrode (working electrode) are of interest, whereas the reaction which takes place at the other electrode leads to the formation of by-products; in the case of anodic syntheses, the cathodic reaction often consists of a discharge of hydrogen.

These processes are often carried out in electrochemical cells deprived of special devices, such as diaphragms or membranes, which are adapted to separate the anodic and the cathodic products from each other, because, under the working conditions, it is known that the cathodic hydrogen is incapable of bringing about any changes in the final composition of the reaction mixture.

We have now found, and this is the subject matter of the present invention, that it is possible to improve the performance of the electrochemical syntheses of organic nature and, moreover, to bring into effect additional reactions between the product of the electrolysis and what is formed at the "inert" electrode, by introducing an appropriate catalyst in the electrochemical cell.

Thus, in the particular case of the anodic syntheses, it is possible, by adopting the technique of the present invention, to exploit the hydrogen which is formed at the cathode, to hydrogenate, either totally or partially, the compound which is formed at the anode.

This is quite general a principle, and the introduction of catalysts during progress of the performance of an electrolysis, or, better defined, the use, as electrode, of catalytic materials, can be made in the case of any kind of electrolysis conducted on organic substrates: the skilled technician will select, from time to time, both the materials and the procedure to be followed in order that the purposes aimed at may be achieved, while such a procedure, however, shall still be encompassed within the scope of the present invention in general.

Reference will be had, as the present disclosure proceeds, to particular cases of embodiment of the invention, mainly in the field of anodic syntheses of organic compounds, exploiting the hydrogen which is evolved at the cathode.

This is an expedient which enables the present Applicants to illustrate and emphasize the prominent features of the invention: it will be easy, then, for anyone skilled in the art, to adapt the teachings which are inherent in the Examples given to the solution of other problems without, however, departing from the scope of the invention which, as outlined above, should be construed in its widest possible acception.

Reference will thus be had, therefore, to a rection of anodic acetoxylation of an aromatic compound containing at least a methyl group carried out in acetic acid in the presence of an acetate.

It is known that, if the teachings of the conventional art are followed, such a process leads to the formation, at the anode, of a mixture of nuclear and benzyl acetates, whereas hydrogen evolves at the cathode according to the following Pattern 1, which relates to a treatment carried out starting from toluene:

Anode:

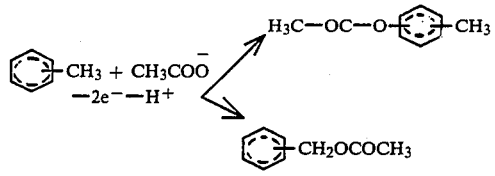

Cathode:

$$2H^+ + 2e^- \longrightarrow H_2$$

The ratio of the nuclear acetates to the benzylic ones is a function of the particular substrate which has been selected and can possibly be varied, though within a very restricted range, by changing, for example, the material which forms the working electrode.

The present Applicants have now found that it is possible drastically to modify such a ratio until completely eliminating from the reaction mixture the benzylic acetates, by reacting the product (or the mixture of products) formed at the anode with the aid of the hydrogen evolved at the cathode: by so doing, an overall hydrogenolysis of the benzylic acetates is brought about according to the following Pattern 2, which is, however, limited to the toluene derivatives.

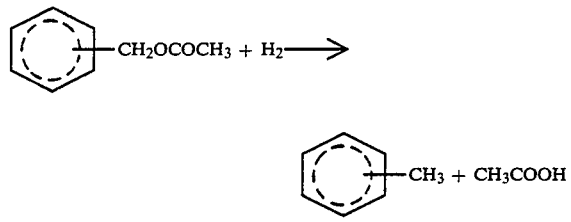

and the starting aromatic substrate is continuously fed to the reaction of formation of the nuclear acetate. This reaction takes place with an appropriate catalyst being present, which can be introduced in the electrolysis environment or can directly form the material of the cathode.

Catalysts which can be used to this purpose are all those which are active in hydrogenation and hydrogenolysis reactions for example, those based on Pd, Pt, Rh and Ru.

These catalysts can be used either as such or appropriately supported: as an alternative and according to a particularly advantageous embodiment of the process of this invention, it is possible to adopt an electrocatalitic cathode which activates the hydrogen that is evolved thereon. The material for such an electro-catalytic cathode can be selected from among the usual cathode materials, such as metals, graphite, carbon, metal oxides appropriately coated by catalitically active substances, or it can consist of the substance itself which is catalitically active and the latter is selected, for example, from among Pd, Pt, Rh, Ru, as such, in admixture, supported or also in the form of their alloys.

The anode, in its turn, consists of a material selected consistently with the anodic process one intends to perform and is selected, for example, from among graphite, carbon, lead, precious metals, as such or properly supported, and bioxides of Pd, Ru, Ir.

As outlined above, in the particular case of acetoxylation, the substrate to be subjected to electrolysis is an aromatic compound the core of which contains at least a methyl group.

The process of this invention, however, is absolutely general and it is deemed fitting to reiterate it, so that, by properly selecting the composition of the electrolyte, the cell type and the working conditions, a number of different reactions can be carried out, the results of many known electrolytic processes being consequently improved or modified.

A number of examples will be reported hereinafter which are intended for illustrating the invention, which, however, should not be regarded as limited thereto.

As a matter of fact, by following the general instructions stemming from the procedure described in the foregoing, which is the subject matter of the present invention, and without departing from the scope thereof, anyone skilled in the art will be enabled to carry out nuclear acyloxylations other than acetoxylations, such as formyloxylations, trifluoroacetoxylations, benzoyloxylations.

Other nuclear functionalization patterns of alkylaromatic compounds, effected by exploiting the means described above for achieving the hydrogenolysis of the corresponding benzylic isomers, are obviously comprised within the objects of the present invention. This is the case, just to cite the most widely known reactions, of the cyanation, methoxylation or halogenation.

This principle is valid also for any other reaction, also different from the mere functionalization, in which it is desired to hydrogenolyze, in the reaction mixtures, the benzyl derivatives in the favour of other products, such as for example in the coupling reactions of alkylaromatic hydrocarbons, both individually (simple coupling) or in admixture (mixed coupling).

An important advantage connected with the process described herein is that, together with the benzyl derivatives, other oxygen-containing by-products which are always formed in more or less important amounts due to unavoidable presence of water in the reaction medium, such as aldehydes and alcohols are hydrogenated and reduced to the starting hydrocarbons, according to the following reaction patterns:

$$Ar{-}CHO \xrightarrow[\text{catalyst}]{2H_2} ArCH_3 + H_2O$$

$$Ar{-}CH_2OH \xrightarrow[\text{catalyst}]{H_2} ArCH_3 + H_2O$$

Also the nature of the substrate can appropriately be changed so that other aromatic substrates can be adopted, and also polycondensates or heterocyclics, which contain at least one aliphatic side chain, possibly functionalized.

Lastly, it should be recalled that it is possible to carry out, still within the scope of the invention, post-modification reactions other than the mere hydrogenolysis, by simply selecting in the appropriate way the catalytic materials and/or the cathode material.

Particularly useful is the case in which the post-modification leads to products which are stable in the reaction medium, because these products are formed only by virtue of the adopted expedients. By so doing, in the anodic reactions, the saturation of aromatic rings or of olefin bonds, or the reduction of functional groups (e.g. the group $-NO_2$ to $-NH_2$) carried out on anodic products by the action of the cathodic hydrogen according to the procedures described herein will be encompassed within the scope of this invention.

EXAMPLES

In order to illustrate the possibilities of application of the invention, a few Examples will be reported, which, at any rate, should not be construed as limitations.

Examples 1 and 2 hereof report the procedure to be followed for the preparation of the nuclear acetates of p.xylene and isodurene in slurry.

Examples 3 and 4 hereof aim only to show that it is possible to operate both with an external catalytic column, or with an electrocatalytic cathode. It can logically be forecast that there will be an improvement of the yields by optimization of the cells in the preparatory stage and of the conditions of operation, as shown by Examples 5 and 6 hereof in which, when working on smaller cells the design of which is easier, better yields can be obtained.

Examples 7 and 8 hereof show, moreover, that the field of application of this invention is extremely wide and that it is even possible to upset the compositions of the mixture of isomeric acetates completely (Example 8).

EXAMPLE 1

Electrosynthesis of 2,5-dimethylphenylacetate 10 mls of p.xylene, 390 mls of potassium acetate, 0.6 M acetic acid and 0.87 g of palladium catalyst on carbon (10% Pd) are electrolyzed in a cell without diaphragm having a graphite anode (area 140 $cm^2$), steel cathode, magnetic stirrer and water jacket. The electrolysis is carried out at 18° C. with a current of 1.40 A. After the flow of 4 F/mol of electricity, the content of the cell is filtered and extracted with dichloromethane. The organic phase is washed with a solution of $NaHCO_3$ and dried over $MgSO_4$. After having distilled off the solvent under atmospherical pressure, the liquid is transferred into a microdistillation apparatus in which 4.30 g of unreacted p.xylene are recovered together with 3.41 g of pure 2,5-dimethylphenyl acetate. The molar values of the yield of current and the stoichiometric yields relative to the synthesis of 2,5-dimethylphenyl acetate from p.xylene are thus 12.8% and 51.3%, respectively.

EXAMPLE 2

Electromechanical synthesis of 2,3,4,6-tetramethylphenylacetate 10 mls of isodurene, 390 mls of potassium acetate/acetic acid (0.6 M) and 1.78 g of catalyst, Pd on carbon (10% Pd) are electrolyzed at 18° C. and 1.40 A as described in the previous Example 1 until 3 F/mol of electricity have flown. By the same procedure as in Example 1 there are obtained 5.30 g of unreacted isodurene and 2.54 g of 2,3,4,6-tetramethylphenyl acetate (pure). The molar values of the current yield and the stoichiometrical yields relative to the synthesis of 2,3,4,6-tetramethylphenyl acetate from isodurene are thus 13.3% and 49.4%, respectively.

EXAMPLE 3

Nuclear acetoxylation of p.xylene with an external catalytic column

The apparatus is a cell of the filterpress type without diaphragm and with a graphite anode (area 20 $cm^2$), stainless steel cathode, and a column containing 20 g of a catalyst composed of Pb on granular carbon (2% Pd) placed at the exit of the cell and a cooler. The solution is caused to circulate by a centrifugal pump. With this apparatus 2 mls of p.xylene in 80 mls of 0.4 M $CH_3COOH/CH_3COOK$ are electrolyzed at 20° C. and 0.2 A until 2 F/mol of current have flown. On completion of the test, a weighed amount of gas-chromatographic standard is added, a sample is filtered, extracted with ether, washed with a solution of $NaHCO_3$, dried over $MgSO_4$ and subjected to gas-chromatographic analysis. There are obtained values of yield of current and stoichiometric yield of 17% and 25%, respectively. The mixture of isomeric acetates is composed of 97% of 2,5-dimethylphenylacetate and 3% of p.methylbenzylacetate.

EXAMPLE 4

Nuclear acetoxylation of p.xylene with an electrocatalytic cathode

The electrochemical cell consists of a central graphite anode (area 140 $cm^2$), around which, insolated by a polypropylene gauze, the catalyst (26 g) is placed, consisting of granulated Pd/C (Pd 2%) which is the cathode. The electric contact is made by a steel gauze. The system is completed by a centrifugal pump and a cooler, as in Example 3. In this apparatus, 5 mls of p.xylene and 200 mls of 0.4 M $CH_3COOH/CH_3COOK$ are electrolyzed at 20° C. and 1.40 A until 2 F/mol of electricity have flown. Operating as in Example 3, there are obtained values of 12% for the yield of current and 26% for the stoichiometric yield. The mixture of isomeric acetates is composed of 94% of 2,5-dimethylphenylacetate and 6% of p.methylbenzylacetate.

EXAMPLE 5

Nuclear acetoxylation of p.xylene in slurry

In a cell having a graphite anode (area 8.5 $cm^2$), a platinum cathode, a magnetic stirrer and a water jacket, there are introduced 10 mls of 0.4 M $CH_3COOH/CH_3COOK$, 1.96 millimol of p.xylene and 24 mg of Pd/C (10% of Pd). The electrolysis is effected at 18° C. and 85 mA. After a flow of current of 2 F/M, a gas chromatographic standard is introduced and the procedure as in Example 3 is followed. There are obtained values of yield of current and stoichiometric yield of 19% and 75%, respectively, for the formation of 2,5-dimethylphenylacetate from p.xylene. The mixture of isomeric acetates is composed of 98% of 2,5-diphenylmethylacetate and of 2% of p.methylbenzylacetate. As a comparative example, the same electrolysis is carried out without any catalyst and the yield of current is 16% and the stoichiometric yield is 30%: the mixture of isomeric acetate is composed of 40% of 2,5-dimethylphenylacetate and 60% of p.methylbenzylacetate.

EXAMPLE 6

Nuclear acetoxylation of isodurene in slurry 10 mls of 0.4 M $CH_3COOH/CH_3COOK$, 2.00 millimols of isodurene and 55 mg of Pd/C (10% Pd) are electrolyzed at 18° C. and 85 mA and analyzed as in Example 5. The yield of current and the stoichiometric yield for the formation of 2,3,4,6-tetramethylphenylacetate from isodurene are 22% and 71%, respectively. The mixture of isomeric acetates is composed of 91% of 2,3,4,6-tetramethylphenylacetate and 9% of the three possible benzyl acetates. In the comparative example made without any catalyst, the yield of current is 15% and the stoichiometric yield is 17%. The mixture of isomeric acetates contains 22% of 2,3,4,6-tetramethylphenyl acetate and 78% of benzyl acetates.

EXAMPLE 7

Nuclear acetoxylation of mesitylene 10 mls of 0.4 M $CH_3COOH/CH_3COOK$, 1.98 millimols of mesitylene and 25 mg of Pd/C (Pd 5%) are electrolyzed at 18° C. and 85 mA and analyzed as in Example 5. The yield of current and the stoichiometric yield are 40% and 79%, respectively, for the formation of 2,4,6-trimethylphenylacetate from mesitylene. The mixture of isomeric acetates contains 100% of 2,4,6-trimethylphenylacetate.

In the comparative example performed without any catalyzer being present, the current yield is 35% and the stoichiometric yield is 61% and the mixture of isomeric acetates contains 93% of 2,4,6-trimethylphenylacetate and 7% of 3,5-dimethylbenzylacetate.

EXAMPLE 8

Nuclear acetoxylation of durene in slurry 10 mls of $CH_3COOH/CH_3COOK$ (0.4 M), 4.07 millimols of durene and 162 mg of Pd/C (Pd 10%) are electrolyzed at 80° C. and 850 mA and analyzed as in Example 5. The yield of current and the stoichiometric yield for the formation of 2,3,5,6-tetramethylphenyl acetate from durene are 6.5% and 45%, respectively. The mixture of isomeric acetates contains 92% of 2,3,5,6-tetramethylphenylacetate and 8% of 2,4,5-trimethylbenzylacetate. In the comparative example carried out without any catalyst being present, the yield of current and the stoichiometric yield are 4.8% and 5.6%, respectively. The mixture of isomeric acetates is composed of 7% 2,3,5,6-tetramethylphenylacetate and 93% of 2,4,5-trimethylbenzylacetate.

We claim:

1. In an electrochemical process conducted in an undivided electrolytic cell having a graphite anode and a platinum cathode, wherein a starting methylbenzene compound, having at least one methyl group bonded to the nucleus thereof, is reacted, at the anode with an acetate in the presence of acetic acid to form the corresponding nuclear acetate and a benzyl acetate by-product, and wherein hydrogen evolves at said cathode, the improvement which comprises adding a hydrogenolysis catalyst comprised of a precious metal on a carbon substrate in an amount sufficient to cause said hydrogen to react, at said cathode, with said benzyl acetate by-product, to regenerate said starting methylbenzene compound and acetic acid.

2. A process as defined in claim 1 wherein said reaction at said anode takes place in the presence of water and oxygen-containing by-products of said starting methylbenzene compound are formed; and said oxygen containing by-products are reacted at said cathode in the presence of said catalyst to regenerate said starting methylbenzene compound and water.

3. A process as defined in claim 2 wherein the reactants at said cathode are sufficiently agitated in the presence of said catalyst to cause said hydrogen to catalytically react with said benzyl acetate by-product and said oxygen-containing by-products of said methylbenzene compound.

4. A process as defined in claim 3 wherein said methylbenzene compound is selected from di-, tri-, and tetramethylbenzenes.

5. A process as defined in claim 1 wherein the reactants at said cathode are sufficiently agitated in the presence of said catalyst to cause said hydrogen to catalytically react with said benzyl acetate by-product.

6. A process as defined in claim 1 wherein the catalyst used is a hydrogenolysis catalyst consisting of palladium on a carbon substrate.

7. A process as defined in claim 1 wherein said methylbenzene compound is selected from di-, tri- and tetramethylbenzenes.

* * * * *